US012369759B2

(12) United States Patent
Pratt et al.

(10) Patent No.: US 12,369,759 B2
(45) Date of Patent: Jul. 29, 2025

(54) PERSONAL CLEANING KIT

(71) Applicants: Gary Pratt, Kimberly, ID (US); Mona Martin, Kimberly, ID (US)

(72) Inventors: Gary Pratt, Kimberly, ID (US); Mona Martin, Kimberly, ID (US)

( * ) Notice: Subject to any disclaimer, the term of this patent is extended or adjusted under 35 U.S.C. 154(b) by 373 days.

(21) Appl. No.: 18/101,421

(22) Filed: Jan. 25, 2023

(65) Prior Publication Data

US 2024/0245268 A1 Jul. 25, 2024

(51) Int. Cl.

| | |
|---|---|
| ***A47K 7/02*** | (2006.01) |
| ***A46B 5/00*** | (2006.01) |
| ***A46B 15/00*** | (2006.01) |

(52) U.S. Cl.

CPC ..... *A47K 7/02* (2013.01); *A46B 5/005* (2013.01); *A46B 15/0087* (2013.01); *A46B 15/0095* (2013.01); *A46B 15/0097* (2013.01); *A47K 7/024* (2013.01); *A47K 7/026* (2013.01); *A47K 7/028* (2013.01); *A46B 2200/1006* (2013.01)

(58) Field of Classification Search

CPC ..... A47K 7/02; A47K 7/024; A47K 7/026; A47K 7/028; A46B 5/005; A46B 15/0087; A46B 15/0095; A46B 15/0097

USPC ..... 4/606; 15/160, 159.1; D28/63

See application file for complete search history.

(56) References Cited

U.S. PATENT DOCUMENTS

| | | | | |
|---|---|---|---|---|
| 5,560,068 | A * | 10/1996 | Blake | A47K 7/026 15/160 |
| 5,729,858 | A | 3/1998 | Riffel | |
| 5,983,433 | A * | 11/1999 | Chapman | A46B 11/002 4/606 |
| D455,867 | S | 4/2002 | Pratt | |
| D706,987 | S | 6/2014 | Rodriguez | |
| 10,376,107 | B1 | 8/2019 | Reneau | |
| 11,122,941 | B2 | 9/2021 | Palacios | |
| 11,154,909 | B2 * | 10/2021 | Brennan | A46B 5/005 |
| 2002/0138930 | A1 * | 10/2002 | Wheeler | A47K 7/026 4/606 |
| 2003/0204927 | A1 * | 11/2003 | Kelly | A47K 7/026 4/606 |
| 2016/0183741 | A1 | 6/2016 | Atchison | |
| 2016/0287031 | A1 | 10/2016 | Williams | |
| 2019/0282038 | A1 | 9/2019 | Margulis | |

FOREIGN PATENT DOCUMENTS

| | | |
|---|---|---|
| WO | WO2015112191 | 7/2015 |

* cited by examiner

*Primary Examiner* — Tuan N Nguyen

(57) ABSTRACT

A personal cleaning kit for including a set of body scrubbing members includes a handle being elongated to facilitate reaching distal areas of a user relative to the hand of the user. The handle has a near end and a far end relative to the user. A circular brush is coupled to the far end and a loop is coupled to the near end. The loop couples to a hook. A back scrubber is positioned to a wall of a shower to facilitate washing a back of the user and a foot scrubber is positioned to a floor of the shower to facilitate washing a foot of the user.

11 Claims, 5 Drawing Sheets

PERSONAL CLEANING KIT

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to cleaning devices and more particularly pertains to a new cleaning device for including a set of body scrubbing members.

(2) Description of Related Art Including Information Disclosed Under 37 CFR 1.97 and 1.98

The prior art relates to cleaning devices and includes a variety of cleaning devices having a brush and a coupler for mounting to a surface in a shower. Known prior art does not include a cleaning device comprising a kit including a back scrubber, a foot scrubber, and a handle having a circular brush.

BRIEF SUMMARY OF THE INVENTION

An embodiment of the disclosure meets the needs presented above by generally comprising a handle being elongated to facilitate reaching distal areas of a user relative to the hand of the user. The handle has a proximal end and a distal end relative to the user. A circular brush is coupled to the distal end and a loop is coupled to the proximal end. The loop is couplable to a hook. A back scrubber is removably positionable to a wall of a shower to facilitate washing a back of the user and a foot scrubber is removably positionable to a floor of the shower to facilitate washing a foot of the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
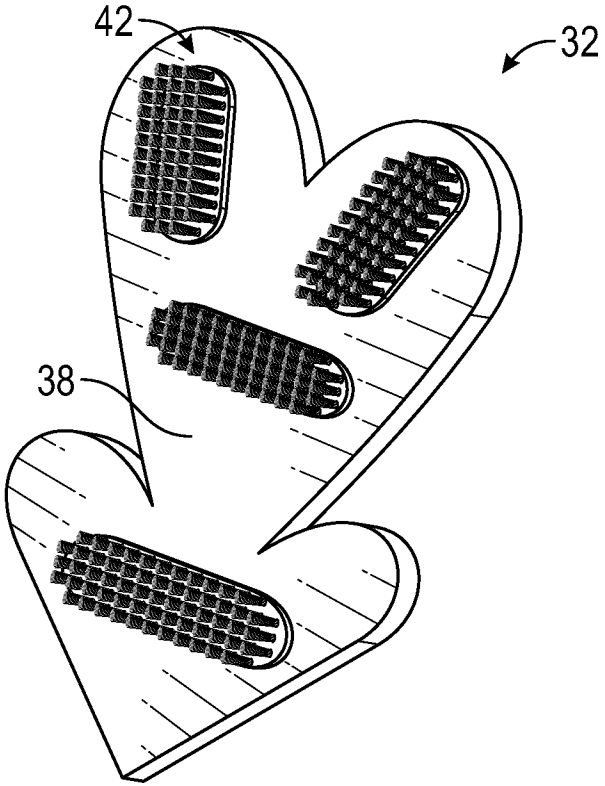
FIG. 1 is a top isometric view of a personal cleaning kit according to an embodiment of the disclosure.
Figure 2:
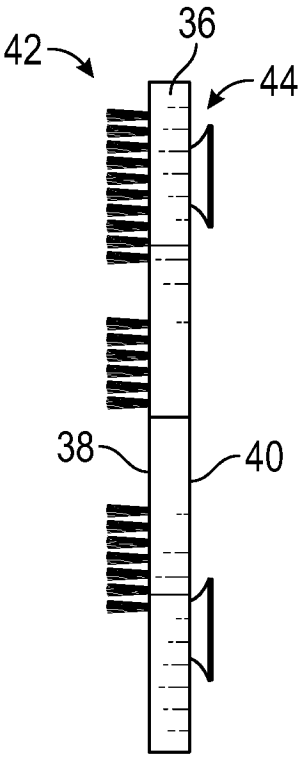
FIG. 2 is a side view of an embodiment of the disclosure.
Figure 3:
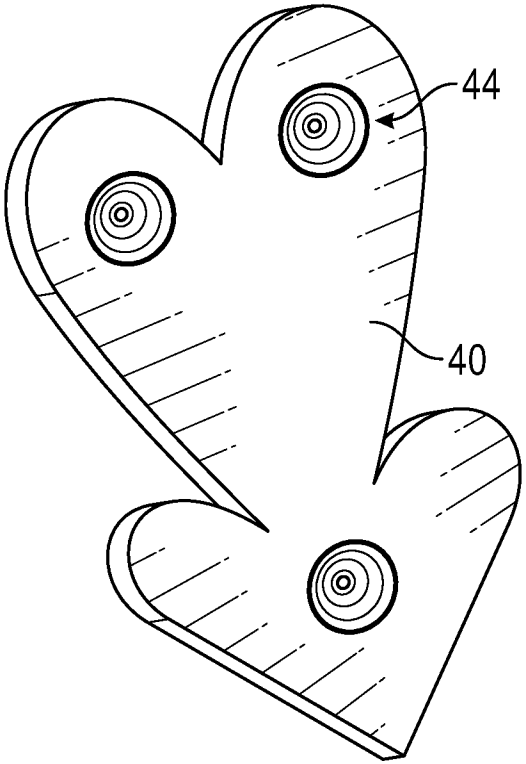
FIG. 3 is a rear isometric view of an embodiment of the disclosure.
Figure 6:
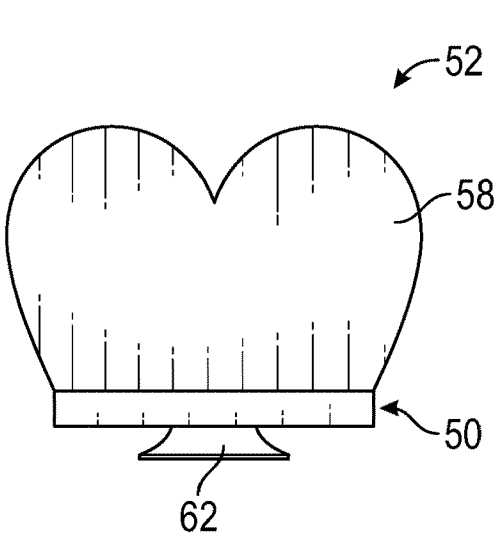
FIG. 6 is a side view of an embodiment of the disclosure.
Figure 5:
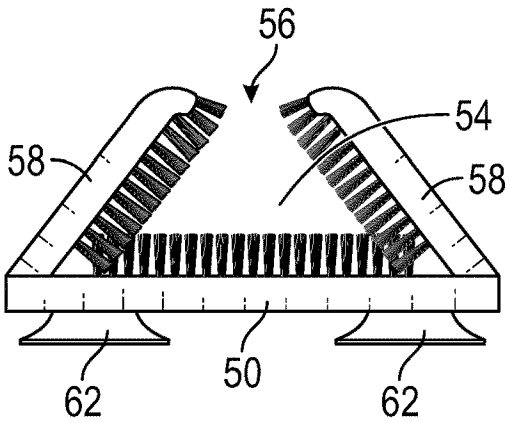
FIG. 5 is a front view of an embodiment of the disclosure.
Figure 4:
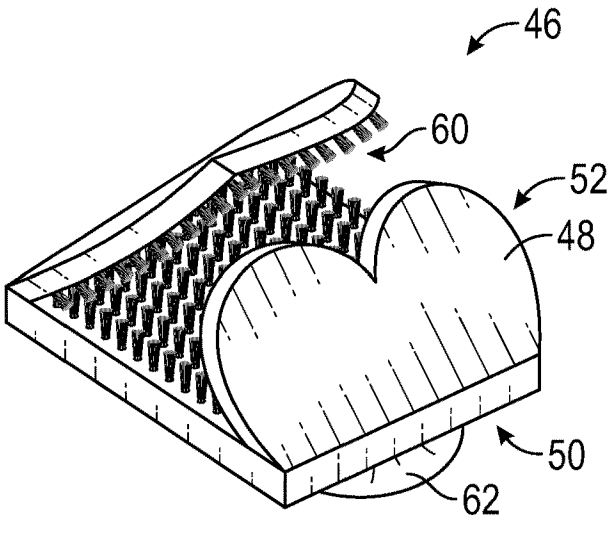
FIG. 4 is a top isometric view of an embodiment of the disclosure.
Figure 7:
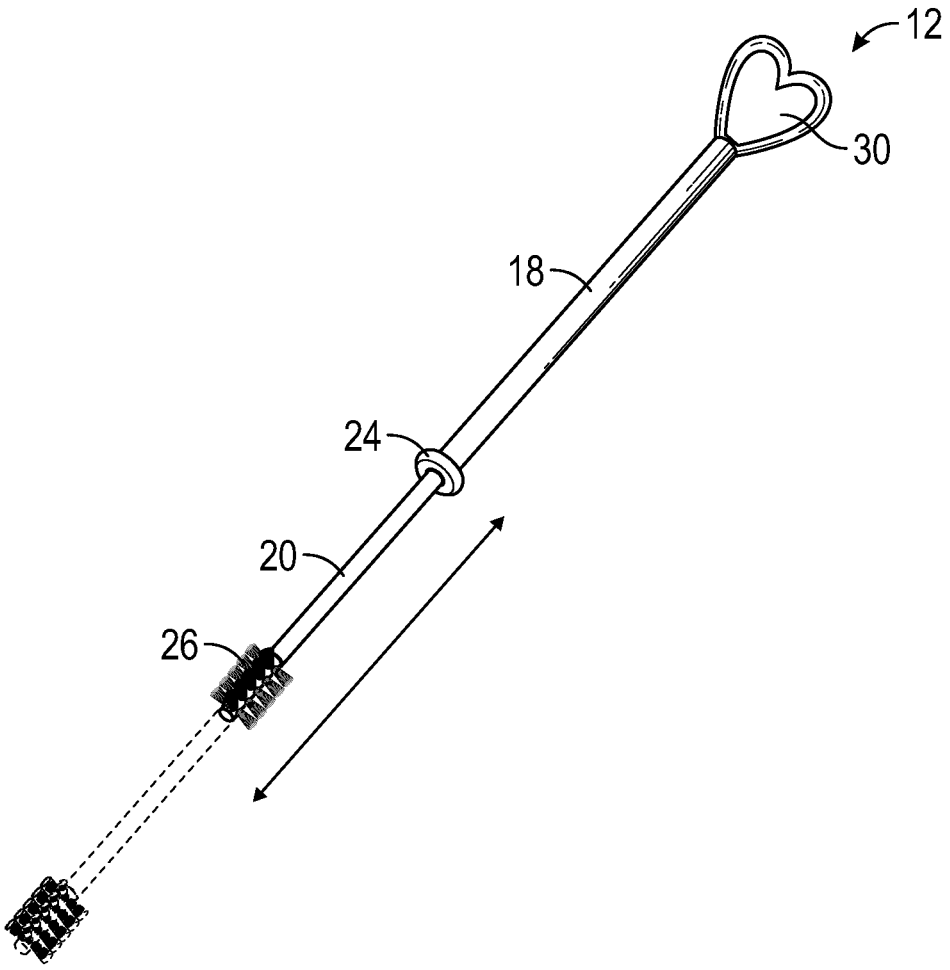
FIG. 7 is a top isometric view of an embodiment of the disclosure.
Figure 8:
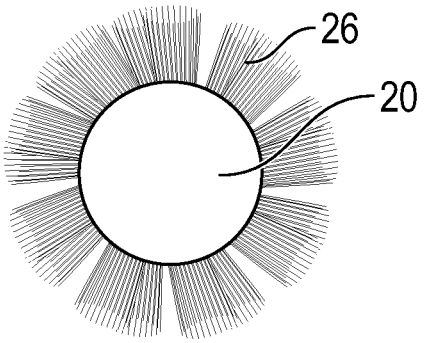
FIG. 8 is a bottom view of an embodiment of the disclosure.
Figure 9:
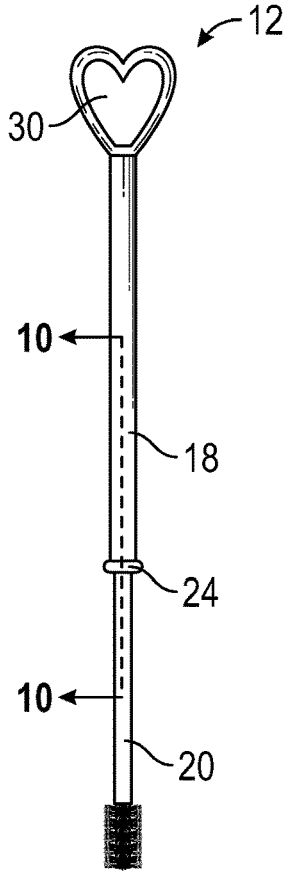
FIG. 9 is a front view of an embodiment of the disclosure.
Figure 10:
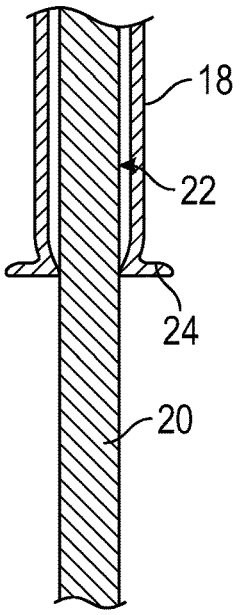
FIG. 10 is a cross-sectional view of an embodiment of the disclosure taken along Line 10-10 of FIG. 9.
Figure 11:
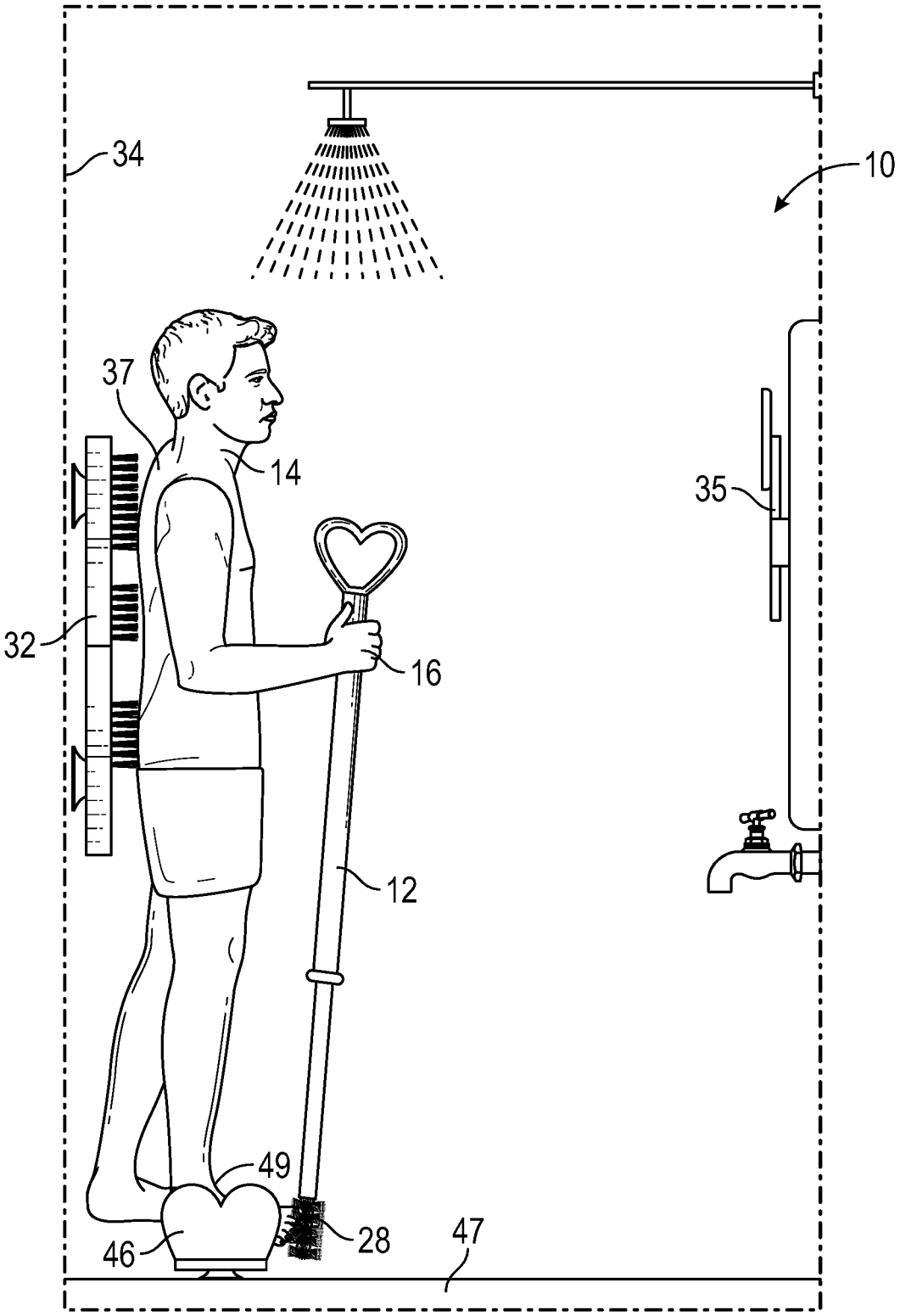
FIG. 11 is an in-use view of an embodiment of the disclosure.

With reference now to the drawings, and in particular to FIGS. 1 through 11 thereof, a new cleaning device embodying the principles and concepts of an embodiment of the disclosure and generally designated by the reference numeral 10 will be described.

As best illustrated in FIGS. 1 through 11, the personal cleaning kit 10 generally comprises a handle 12 being elongated to facilitate reaching distal areas of a user 14 relative to the hand 16 of the user 14. The handle 12 has a proximal end 18 and a distal end 20 relative to the user 14. The handle 12 may be telescopic wherein the distal end 20 is extendable from the proximal end 18. The distal end 20 may comprise a rod and the proximal end 18 may comprise a tube, wherein the distal end 20 may be inserted within an interior 22 of the proximal end 18 and may be releasably retained in a fixed position by a collar 24 positioned at an end of the proximal end 18.

A circular brush 26 is coupled to the distal end 20 is typically positionable between each of the toes 28 of a plurality of toes 28 of the user 14. A loop 30 is coupled to the proximal end 18 is couplable to a hook, wherein the loop 30 may be stored by hanging from the hook. The loop 30 may be heart shaped and configured to invoke positive emotions of the user 14.

A back scrubber 32 is removably positionable to a wall 34 of a shower 35 to facilitate washing a back 37 of the user 14. The back scrubber 32 includes a panel 36 having a front surface 38 and a back surface 40. The panel 36 may be heart shaped, wherein the panel 36 may be configured to invoke positive emotions of the user 14. A plurality of back brushes 42 is coupled to the front surface 38 and is normally abuttable to the back 37 of the user 14. At least five back brushes 42 of the plurality of back brushes 42 are normally positioned on the front surface 38 to abut multiple areas of the back 37 of the user 14 when in-use. A plurality of couplers 44 is coupled to the back surface 40 and removably mounts to the wall 34 of the shower. Each coupler 44 comprises a suction cup being couplable to any conventional walls of showers.

A foot scrubber 46 is removably positionable to a floor 47 of the shower to facilitate washing a foot 49 of the user 14. The foot scrubber 46 includes a housing 48 being a horseshoe shape and having a bottom side 50, a top side 52, and a pair of ends 54. Each end 54 is open and the top side 52 has an opening 56 extending therethrough and though the pair of ends 54. A pair of side walls 58 is defined on opposite sides of the opening 56. Each of the side walls 58 is planar and is angled toward each other to define the opening 56. Each of the side walls 58 may be heart shaped to invoke positive emotions of the user 14, similar to the panel 36 and the loop 30.

A plurality of bristles 60 is coupled to an interior surface of the housing 48, wherein the bristles 60 are abuttable to a top and a bottom of the foot 49 simultaneously. A plurality of fasteners 62 is mounted on the bottom side 50 of the foot scrubber 46 and each fastener 62 comprises a suction cup being couplable to any conventional floors of showers.

In use, the back scrubber 32 is mounted to the wall 34 in the shower 35 and the foot scrubber 46 is mounted to the floor 47 in the shower 35. The back 37 of the user 14 may abut the plurality of back brushes 42 to facilitate cleaning the back 37 of the user 14, wherein the user 14 is prevented from turning into an uncomfortable position to wash the back 37. The foot 49 of the user 14 is inserted through one of the pair of ends 54 of the foot scrubber 46 to abut the top and the bottom of the foot 49 to the plurality of bristles 60, wherein the user 14 is prevented from bending over to clean the foot 49. The circular brush 26 of the handle 12 may be positioned between each of the toes 28 of the plurality of toes 28 of the user 14 to facilitate cleaning the toes 28. The distal end 20 of the brush may be extended from the proximal end 18 to facilitate reaching the circular brush 26 to the foot 49 of the user 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A personal cleaning kit comprising:
a handle being elongated to facilitate reaching distal areas of a user relative to the hand of the user, said handle having a proximal end and a distal end relative to the user;
a circular brush being coupled to said distal end;
a loop being coupled to said proximal end, said loop being couplable to a hook;
a back scrubber being removably positionable to a wall of a shower to facilitate washing a back of the user; and
a foot scrubber being removably positionable to a floor of the shower to facilitate washing a foot of the user.

2. The personal cleaning kit of claim 1, wherein said handle is telescopic, wherein said distal end is extendable from said proximal end.

3. The personal cleaning kit of claim 1, wherein said circular brush is positionable between a pair of toes of the user.

4. The personal cleaning kit of claim 1, wherein said loop has a heart shape.

5. The personal cleaning kit of claim 1, wherein said back scrubber includes a panel having a front surface and a back surface, said panel being heart shaped.

6. The personal cleaning kit of claim 5, further including a plurality of back brushes being coupled to said front surface, said back brushes being abuttable to the back of the user.

7. The personal cleaning kit of claim 6, further including a plurality of couplers being coupled to said back surface and removably mounting to the wall of the shower, each coupler comprising a suction cup.

8. The personal cleaning kit of claim 1, wherein said foot scrubber includes a housing being a horseshoe shape and having a bottom side, a top side, and a pair of ends, each end being open, said top side having an opening extending therethrough and though said pair of ends, a pair of side walls being defined on opposite sides of said opening, each of said side walls being planar and being angled toward each other to define said opening, each of said side walls being a heart shape.

9. The personal cleaning kit of claim 8, further including a plurality of bristles being coupled to an interior surface of said housing, wherein said bristles being abuttable to a top and a bottom of the foot simultaneously.

10. The personal cleaning kit of claim 9, further including a plurality of fasteners being mounted on said bottom side of said foot scrubber, each fastener comprising a suction cup.

11. A personal cleaning kit comprising:
a handle being elongated to facilitate reaching distal areas of a user relative to the hand of the user, said handle having a proximal end and a distal end relative to the user, said handle being telescopic wherein said distal end is extendable from said proximal end;
a circular brush being coupled to said distal end, said circular brush being positionable between a pair of toes of the user;
a loop being coupled to said proximal end, said loop being couplable to a hook, said loop having a heart shape;
a back scrubber being removably positionable to a wall of a shower to facilitate washing a back of the user, said back scrubber including:
a panel having a front surface and a back surface, said panel being heart shaped:
a plurality of back brushes being coupled to said front surface, said back brushes being abuttable to the back of the user; and a plurality of couplers being coupled to said back surface and removably mounting to the wall of the shower, each coupler comprising a suction cup;

a foot scrubber being removably positionable to a floor of the shower to facilitate washing a foot of the user, said foot scrubber including:

a housing being a horseshoe shape and having a bottom side, a top side, and a pair of ends, each end being open, said top side having an opening extending therethrough and though said pair of ends, a pair of side walls being defined on opposite sides of said opening, each of said side walls being planar and being angled toward each other to define said opening, each of said side walls being a heart shape;

a plurality of bristles being coupled to an interior surface of said housing, wherein said bristles being abuttable to a top and a bottom of the foot simultaneously; and a plurality of fasteners being mounted on said bottom side of said foot scrubber, each fastener comprising a suction cup.

* * * * *